United States Patent [19]

Meneely

[11] Patent Number: 4,848,289

[45] Date of Patent: Jul. 18, 1989

[54] APPARATUS AND METHOD FOR RETARDING AN ENGINE

[75] Inventor: Vincent A. Meneely, Langley, Canada

[73] Assignee: Pacific Diesel Brake Co., British Columbia, Canada

[21] Appl. No.: 189,282

[22] Filed: May 2, 1988

[51] Int. Cl.[4] ..... F01L 13/08; F02D 9/06

[52] U.S. Cl. ..... 123/182; 123/320; 123/323

[58] Field of Search ..... 123/84, 85, 182, 320, 123/323

[56] References Cited

U.S. PATENT DOCUMENTS

| | | | |
|---|---|---|---|
| 1,637,118 | 7/1927 | Kirchensteiner | 123/320 |
| 3,330,263 | 7/1967 | Weglage et al. | 123/182 |
| 4,395,884 | 8/1983 | Price | 60/602 |
| 4,474,006 | 10/1984 | Price | 60/602 |
| 4,572,114 | 2/1986 | Sickler | 123/90.13 |
| 4,662,332 | 5/1987 | Bergmann et al. | 123/323 |

FOREIGN PATENT DOCUMENTS

| | | | |
|---|---|---|---|
| 2820941 | 11/1978 | Fed. Rep. of Germany | 60/602 |
| 0003437 | 1/1985 | Japan | 123/323 |

*Primary Examiner*—Charles J. Myhre
*Assistant Examiner*—Weilun Lo
*Attorney, Agent, or Firm*—Shlesinger & Myers

[57] ABSTRACT

The invention includes an apparatus for retarding an engine. There is a mechanism, such as a master and slave cylinder arrangement, for cracking open each exhaust valve of each cylinder of the engine near top dead center of each compression stroke. There is also provision for increasing the pressure of gases in the exhaust manifold sufficiently to open exhaust valves of other cylinders on the intake stroke after each exhaust valve on the compression stroke is so opened. The provision for increasing the pressure of gases in the exhaust manifold may include retarding timing of the cracking open of the exhaust valves on the compression stroke and a valve or other device for restricting a flow of exhaust gases from the exhaust manifold.

15 Claims, 2 Drawing Sheets

APPARATUS AND METHOD FOR RETARDING AN ENGINE

BACKGROUND OF THE INVENTION

The invention relates to an apparatus and method for retarding internal combustion engines, typically diesel engines, by releasing compressed gases from each cylinder through an exhaust valve a compression near the top dead centre position of a compression stroke during, and same time, opening the exhaust valve of a cylinder on an intake stroke.

Truckers commonly encounter the problem of slowing heavy trucks, usually diesel-powered trucks, on long downgrades. It is well known that excessive use of conventional brakes leads to premature break wear and to overheating of the brakes. Consequently, it is well known to slow trucks with diesel engines by compression release retarding devices. These devices operate by cracking open each exhaust valve just prior to top dead centre of each compression stroke with the fuel supply to the engine cut off. The compressed gases are then diverted into the exhaust manifold, instead of being retained in each cylinder, which would provide an undesirable rebound effect and cancel the braking effect of the compression stroke.

Patents have been issued for engine braking devices of this type, including the following United States patents assigned to Jacobs Manufacturing Company: U.S. Pat. Nos. 4,592,319; 4,339,787; 4,398,510; 4,473,047; 4,423,712; 4,395,884; 4,474,006; 4,485,780; 4,510,900 and 4,572,114.

There is also U.S. Pat. No. 4,655,178 issued to the present inventor.

In my own previous U.S. patent application Ser. No. 07/015,683 filed Feb. 17, 1987, there was disclosed the principle of opening an exhaust valve of a cylinder on the intake stroke while cracking open an exhaust valve near top dead centre of a compression stroke. This causes the gases from the cylinder on the compression stroke to be diverted into the cylinder on the intake stroke, thus increasing the charge received in each cylinder. When that same cylinder reaches the compression stroke, there is more charge in the cylinder, thereby increasing the braking effect as the gases are compressed. In that previous application, hydraulic means was employed to operatively engage all of the exhaust valves of a group of cylinders, such that all of the exhaust valves of that group of cylinders are opened simultaneously. The exhaust valve of a first cylinder is cracked open when the cylinder is near top dead centre of a compression stroke, the other two cylinders being on the intake stroke and exhaust stroke respectively.

It is also known to retard engines using an exhaust restrictor. Exhaust restriction in itself provides a braking effect by providing a back pressure when each cylinder is on the exhaust stroke.

SUMMARY OF THE INVENTION

One aspect of the invention provides a method for retarding an engine including the steps of opening a first exhaust valve of a first cylinder of the engine near top dead centre of each compression stroke of the first cylinder, and increasing the pressure of gases in the exhaust manifold sufficiently to open a second exhaust valve of a second cylinder on the engine on each intake stroke of the second cylinder after the first exhaust valve so opens.

The pressure of gases in the exhaust manifold may be increased by restricting the outflow of exhaust gases from the manifold and by retarding opening of the first exhaust valve. The opening of the exhaust valves may be retarded longer than usual because of the increased exhaust manifold pressure. This increased pressure on the top of the valve counters the pressure exerted by the gases in the cylinder and thus reduces the loading on the valve opening mechanism. This increases the normal limits of retarding because the cylinder pressure and loading on the valve opening components increase the longer the opening of the valves is retarded on the compression stroke.

A second aspect of the invention provides an apparatus for retarding a multi-cylinder, four-stroke engine having intake valves and exhaust valves, the exhaust valves communicating with a common exhaust manifold. The apparatus includes means for opening a first exhaust valve of a first cylinder of the engine near top dead centre of each compression stroke of the first cylinder. There is also means for increasing the pressure of gases in the exhaust manifold sufficiently to open a second exhaust valve of a second cylinder on each intake stroke of the second cylinder after the first exhaust valve is so opened.

The means for increasing the pressure of gases in the exhaust manifold may include means for restricting a flow of gases from the exhaust manifold and means for retarding opening of the first exhaust valve to increase the pressure of gases released from the first cylinder. To date both means have been used in combination. It is believed that in some cases the exhaust restriction alone may be sufficient.

The present invention can considerably increase the braking horsepower achieved by a compression release-type engine braking device. The invention has achieved this desirable object by diverting exhaust gases from the exhaust manifold to increase the charge of each cylinder on the intake stroke. Furthermore, it is not necessary to redesign the type of engine braking apparatus employed. The longer the cracking open of the valve is delayed, the greater the pressure of gases compressed within the cylinder, and thus the greater the pressure pulse generated in the exhaust manifold when the valve is cracked open. In some cases this pulse may be sufficiently strong to open a normally closed exhaust valve of a cylinder on the intake stroke. It will be realised that only the valve spring maintains a valve closed when the cylinder is on the intake stroke. There is a negative pressure within the cylinder due to the downward motion of the piston, which tends to open the valve. Thus the exhaust valve can be opened against the closing force of the valve spring if there is a sufficient pressure.

Simultaneously, the pressure in the exhaust manifold can be raised by restricting the outflow of exhaust gases from the manifold. A moveable exhaust restrictor is placed in the exhaust system for this purpose. Then the combined pressure of the pulse of gases released into the exhaust and the raised pressure in the manifold is sufficient to open the exhaust valve of a cylinder on the intake stroke.

As a further alternative, both means may be combined in some cases. In other words, an exhaust restrictor may be used together with further retarding the timing of the cracking open of the exhaust valve for each cylinder near top dead centre of its compression stroke. These two means of increasing the pressure in the manifold are both utilized to open the exhaust valve of the cylinder on the intake stroke. In some cases it may be necessary to use a new compression release retarding device where the existing one is incapable of being retarded enough.

DESCRIPTION OF THE PREFERRED EMBODIMENTS

Figure 1:
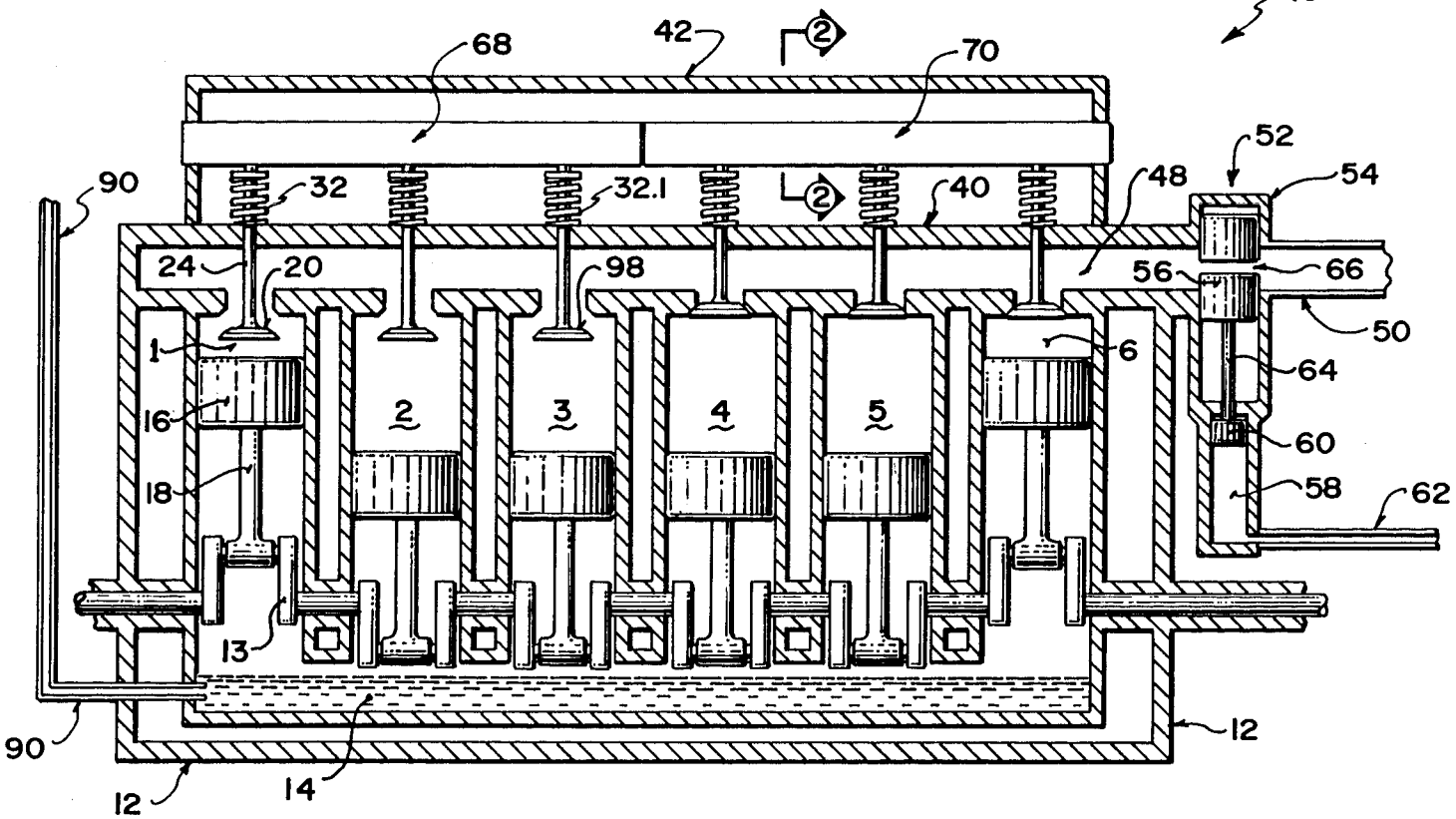
FIG. 1 is a partly diagrammatic and simplified longitudinal, sectional view of a diesel engine fitted with a compression release retarding device and an exhaust restrictor.

Referring to the drawings, FIG. 1 shows a conventional diesel engine 10, having a block 12 with a crankshaft 13 located in crankcase 14. The engine has a plurality of pistons, one for each cylinder, such as piston 16 of cylinder 1. The pistons are connected to the crankshaft in the conventional manner by connecting rods such as connecting rod 18.

Each cylinder is provided with exhaust valves and intake valves. The intake valves are not shown in FIG. 1, and only one exhaust valve is shown for each cylinder, such as valve 20 of cylinder 1. Each of the cylinders, as with many diesel engines used in heavy trucks, may have a pair of exhaust valves and cylinder 1 has a second exhaust valve 22 shown in FIG. 2. The two exhaust valves 20 and 22 have valve stems 24 and 26 and valve springs 32 and 33. The conventional valve opening mechanism includes a crosshead 28, with a depending tube 30 extending downwardly therefrom. This structure is not shown in FIG. 1. In the conventional manner, the valve is opened by a rocker arm 34 which presses downwardly on crosshead 28 to open both exhaust valves when required.

Figure 2:
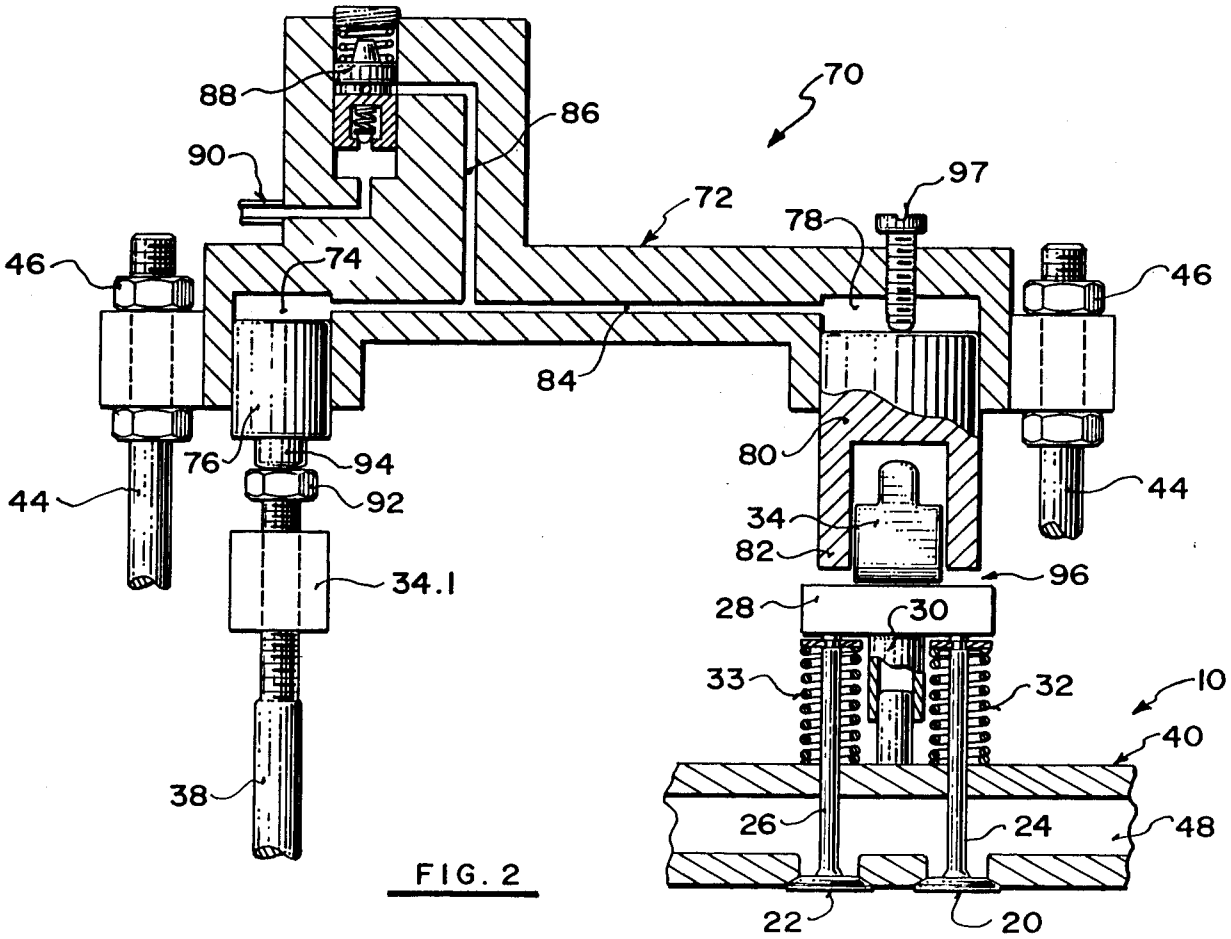
FIG. 2 is a partly diagrammatic, sectional view of a compression release retarding device taken along line 2—2 of FIG. 1 and showing fragments of the engine.

The rocker arm is activated by a push tube, such as push tube 38 shown for another rocker arm 34.1 in FIG. 2. The push tube is received in a cam follower which acts on a camshaft, not shown in the drawings. This is conventional for such engines. The camshaft rotates and lifts the push tube at the appropriate time to depress the opposite end of the rocker arm and open the exhaust valves.

Referring back to FIG. 1, the engine 10 has a cylinder head 40. The engine has six cylinders numbered 1, 2, 3, 4, 5 and 6 in the conventional manner. It also has a conventional exhaust manifold 48 shared in common with all of the exhaust valves in this case. This allows exhaust gases released from the cylinders to leave the engine through exhaust outlet 50.

FIG. 1 shows the engine in combination with an exhaust restrictor 52. The exhaust restrictor is conventional and includes a slave cylinder 54 having a slave piston 56 slideably received therein. The restrictor also includes a master cylinder 58 having a master piston 60 slideably received therein. The master cylinder is a pneumatic cylinder and has a pnuematic line 62 connected thereto. The slave piston is connected to the master piston by means of a connecting rod 64 and has a passageway 66 extending diametrically therethrough, when pneumatic pressure is applied to the master cylinder by means of pneumatic line 62, the master piston and slave piston are both raised to the position of FIG. 1 wherein the slave piston blocks exhaust outlet 50 from exhaust manifold 48. The only outlet for the exhaust from the manifold is through passageway 66 in the slave piston. When the pneumatic pressure is released, both pistons drop so the exhaust gases can pass freely from exhaust manifold 48 to exhaust outlet 50, piston 56 being below the outlet and manifold.

Engine 10 is also provided with a pair of compression release retarding devices 68 and 70. These devices are generally conventional and are, in principle, the same as each other. Device 68 is used for cylinders 1–3, and device 70 is used for cylinders 4–6. The devices are interposed between cylinder head 40 and valve cover 42 in the previously known manner and are held in place by the bolts 44 and nuts 46 as shown in FIG. 2 for device 70.

Both devices 68 and 70 include a body 72 and shown for device 70 in FIG. 2. This body is a casting in the preferred embodiment as illustrated. The body is adapted in this case for half the cylinders of a six cylinder engine and 58 includes three master cylinders, such as master cylinder 74 as shown in FIG. 2. Each master cylinder has a master piston 76 slideably received therein. The body 72 has three slave cylinders, such as slave cylinder 78. There is one slave cylinder for the exhaust valves of each of the cylinders for which the device used. In this case, slave cylinder 78 has a slave piston 80 with a bifurcated lower portion 82 which operatively contacts exhaust valves 20 and 22 of cylinder 1 by means of crosshead 28. The slave cylinder 78 is hydraulically connected to master cylinder 74 by means of an hydraulic fluid conduit 84. The hydraulic fluid employed is engine oil received from conduit 86 which extends to a spool valve 88. Valve 88 in turn is connected to another hydraulic conduit 90 which extends through an electric solenoid valve (not shown) to the bottom of crankcase 14 as shown in FIG. 1.

In such devices, each master piston is positioned to operatively contact a push tube of the engine and has an associated slave piston which operatively contacts an exhaust valve. The particular push tube is chosen such that the slave piston will be depressed downwardly just before top dead centre on the compression stroke of its cylinder. In the illustrated example, master piston 74 is positioned over push tube 36 which contacts rocker arm 34.1 for the exhaust valve of cylinder 2 as shown in FIG. 1. Of course, the particular push tube chosen depends upon the configuration of the engine involved. In this case, push tube 38 has been selected because it is actuated at the proper time, that is, prior to top dead centre of cylinder 1 on its compression stroke. In other engines, a different push tube, or possibly some other engine component is employed. As is known, in alternative embodiments electronic control or a pulse generator may be used to control actuation of each of the master cylinders. In the present case, however, where push tubes are used, a hardened adjustment screw 92 theadedly received on rocker arm 34.1 is positioned to contact a projection 94 on the bottom of the master piston 76.

There is a gap 96 identified by arrows between the slave piston and crosshead 28 in FIG. 2. A gap is conventionally employed on such devices for timing purposes. There is rarely, if ever, a push tube which lifts at just the proper time to crack open the exhaust valves just prior to top dead centre of the compression stroke. It is clearly impossible to utilize a push tube which lifts too late, so conventionally push tubes are employed which in fact begin lifting before cracking open of valves 20 and 22 is desired.

It has been recognized that it is desirable to crack open valves 20 and 22 as close as possible to top dead centre of the compression stroke because the braking effect increases greatly as the piston approaches top dead centre of the compression stroke. The pressure within the cylinder rises considerably towards the end of the stroke and thus, if the exhaust valves are cracked open too early, considerable braking force is lost. At the same time, the exhaust valves must open sufficiently before the top dead centre position such that the compressed gases in the cylinder are completely released before the subsequent expansion stroke begins. If not, the compressed gases remaining within the cylinder have an undesired rebound effect on the piston, which diminishes the braking effect.

The timing of cracking open of the exhaust valves in the embodiment of FIG. 2, is, as stated above, governed by the amount of gap 96 provided between the slave piston and the crosshead 28. The size of the gap is adjusted by rotation of adjustment screw 97. The screw limits upward movement of slave piston 80 and thus the amount of gap 96. It is adjusted so the slave piston contacts the crosshead just as the cracking open of the exhaust valve is desired.

As is known in such devices, the solenoid valve referred to above is controlled by a switch within the cab of the vehicle to supply oil to conduit 90 when compression release retarding is desired, typically on a downgrade. Thus, when master piston 76 is raised by push tube 36 acting thrugh rocker arm 34.1 and adjustment screw 92, the hydraulic system comprising the master cylinder 74, conduits 84 and 86 and master cylinder 78 is closed by spool valve 88. Therefore, the lifting of the master piston 76 must be accompanied by downward movement of slave piston 80. The lower end 82 of the slave piston pushes on crosshead 28, thus opening the valves 20 and 22.

While the compression release devices 68 and 70 are conventionally used on diesel engines such as engine 10, and while exhaust restrictors such as exhaust restrictor 52 are also conventional, it has not been conventional to utilize exhaust restrictors in combination with compression release retarding devices on such engines as contemplated by the invention in order to increase the braking effect achieved. In essence, the invention relates to raising the exhaust gas pressure momentarily in the exhaust manifold 48 sufficiently high to crack open the exhaust valves of cylinders on the intake stroke. As discussed above, only the valve springs keep the exhaust valves closed at this time. By way of example, in FIG. 1, exhaust valve 98 of cylinder 3 has been so opened against the pressure of valve spring 32.1. Both such exhaust valves of the cylinder are so opened, although only one is illustrated in FIG. 1. It may be perceived that the exhaust valve can be opened in this manner if the pressure in exhaust manifold 48 is sufficiently great to act upon the top of the exhaust valve 98, and overcome the force of spring 32.1 which tends to keep the valve closed.

This momentary high pressure in the exhaust manifold at the appropriate time is achieved in the preferred embodiment by use of two mechanisms. The first is exhaust restrictor 52. In itself, the exhaust restrictor provides a braking effect by retarding the flow of exhaust gases from the manifold, thus causing a back pressure on the piston of each cylinder on the exhaust stroke. However, according to the present invention, the exhaust gas restrictor is employed to increase the braking effect in a manner not previously contemplated. The slave piston 56 is deployed in the position shown in FIG. 1 when the braking effect is desired, thus increasing the pressure in the exhaust manifold 48.

The compression release retarding devices 68 and 70 are employed in the conventional manner to crack open the exhaust valves of each cylinder just before top dead centre of the compression stroke to remove the rebound effect of the compressed gases in each cylinder. As is shown in FIG. 1, exhaust valve 20 of cylinder 1 has been cracked open by device 68. When the valve is so cracked open, a high pressure pulse propagates through the manifold 48 because the pressure of gases released from cylinder 1 is higher than the normal pressure in the manifold. However, the pressure thus created in the manifold is not conventionally high enough to create the desired effect. According to the invention, the exhaust gas restrictor is employed as means for increasing the pressure of gases in the exhaust manifold prior to cracking open of each set of exhaust valves near top dead centre of the compression stroke. In addition, the gap 96 shown in FIG. 2 is increased to delay cracking open of these valves so that the pressure pulse propagated through the manifold, when added to the background pressure in the manifold already created by the exhaust gas restrictor, is sufficiently high to pop open the exhaust valves for the cylinders on the intake stroke. Thus there is a synergistic effect achieved by combining the compression release retarder and the exhaust restrictor not achieved by either element alone.

Of course, the exact pressure required in the exhaust manifold depends upon the configuration of the particular engine including the compression force of the springs of the exhaust valves and the size of the exhaust valves. Likewise, the means for cracking open the exhaust valves of the cylinders on the intake stroke can be varied even for the same engine. Whatever the means, the instantaneous pressure in the exhaust manifold must be sufficient to pop open the exhaust valaves of the cylinders on the intake stroke, for example exhaust valve 98 shown in FIG. 1, just after the compressed gases are released from the cylinder near top dead centre of the compression stroke for example, exhaust valve 20 of cylinder 1. In this manner, referring to FIG. 1, the compressed gases released from cylinder 1 are to some extent diverted into cylinder 3 to increase the charge of cylinder 3, and therefore the braking force on the subsequent compression stroke of cylinder 3. If the pressure pulse created in the manifold by the cracking open of valve 20 is increased by retarding the opening of the valve as discussed above, then less pressure increase needs to be achieved by the exhaust gas restrictor 52. Likewise, if the pressure in the manifold is increased more by restrictor 52, then less retarding of the cracking open of valve 20 is required.

While the required pressure may be derived from various combinations of exhaust gas restriction and retarding of the cracking open of exhaust valves near top dead centre of the compression stroke, there are practical limitations for any particular engine. For example, as mentioned above, the maximum pressure pulse created by the cracking open of the exhaust valves near top dead centre of the compression stroke is limited by the need to completely purge each cylinder prior to commencement of the expansion stroke.

In some cases, the cracking open of the exhaust valves during the intake stroke may be achieved by one only of the two means. In other words, restricting the outflow of exhaust gases with an exhaust restrictor may in some cases be sufficient to crack open the exhaust valves during the intake stroke even with conventional timing by gap 96. However, in the preferred embodiment both means described are utilized together to achieve the desired effect.

By way of example only, in one example a Caterpillar diesel engine was modified according to the invention by providing a pressure in the exhaust manifold of 50 p.s.i. utilising restrictor 52. Conventionally the pressure is approximately 10 p.s.i. or 10 to 15 p.s.i. with a turbo charger. The timing for the cracking open of valve 20, as with all of the valves prior to top dead centre of the compression stroke, was prior to modification, achieved by having gap 96 of 0.070". According to the invention, the gap was increased to 0.100", thus further retarding the cracking open of the exhaust valves prior to top dead center of the compression stroke. With this particular combination, a substantial increase of at least 25% in the braking horsepower was achieved on a test engine.

As is discussed above, when the exhaust valves, such as valve 98 of FIG. 1, are cracked open on the intake stroke, pressurized exhaust gases enter the cylinder through the open exhaust valves. The valves subsequently close when the pressure drops, trapping the exhaust gases in the cylinder. The cylinder then begins the compression stroke with an increased charge, and the braking effect is increased due to the greater amount of gases in the cylinder compressed on the subsequent compression stroke.

Normal operation of the engine is resumed by means of the previously mentioned switch in the truck cab which activates the solenoid of valve 88 to move the valve spool and thus allow oil to travel through conduits 86 and 90 back to the crankcase when the master pistons are raised. The exhaust gas restrictor 52 is inactivated by lowering slave piston 56, and fuel is again supplied to the engine.

What is claimed is:

1. A method for retarding an engine, comprising the steps of:

opening a first exhaust valve of a first cylinder of the engine near top dead centre of each compression stroke of the first cylinder; and increasing the pressure of gases in the exhaust manifold sufficiently to open a second exhaust valve of a second cylinder of the engine on each intake stroke of the second cylinder after said first exhaust valve so opens.

2. A method as claimed in claim 1, wherein the pressure of gases in the exhaust manifold is increased by delaying opening of the first exhaust valve.

3. A method as claimed in claim 1, wherein the pressure of gases in the exhaust manifold is increased by restricting the outflow of exhaust gases from the manifold.

4. A method as claimed in claim 1, wherein the pressure of gases in the exhaust manifold is increased by delaying opening of the first exhaust valve and by restricting the outflow of exhaust gases from the exhaust manifold.

5. A method as claimed in claim 1, wherein the second exhaust valve is opened while the first exhaust valve is open.

6. An apparatus for retarding a multi-cylinder, four stroke engine having intake valves, and exhaust valves communicating with a common exhaust manifold, the apparatus comprising:

means for opening an exhaust valve of each cylinder of the engine near top dead center of each compression stroke; and means for increasing the pressure of gases in the exhaust manifold sufficiently to open an exhaust valve of another cylinder of the engine on an intake stroke after each said exhaust valve is so opened.

7. An apparatus as claimed in claim 6, wherein the means for increasing includes means for restricting a flow of exhaust gases from the manifold.

8. An apparatus as claimed in claim 7, wherein the means for restricting includes a valve.

9. An apparatus as claimed in claim 6, wherein the means for increasing includes means for retarding opening of each said exhaust valve near top dead centre of each said compression stroke to increase the pressure of gases released from each said cylinder.

10. An apparatus as claimed in claim 9, wherein the valves are operated by push tubes, the means for opening each said exhaust valve including a slave cylinder having a slave piston operatively contacting each said exhaust valve, a master cylinder having a master piston operatively contacting one said push tube, and an hydraulic conduit between the master cylinder and slave cylinder, the means for retarding including a gap operatively between the slave piston and each said exhaust valve prior to said opening of each said exhaust valve.

11. In combination:

a multi-cylinder, four stroke internal combustion engine having intake valves and exhaust valves communicating with a common exhaust manifold; and an apparatus for retarding the engine including means for opening each exhaust valve of each cylinder of the engine near top dead centre of each compression stroke; and means for increasing the pressure of gases in the exhaust manifold sufficiently to open another exhaust valve of another cylinder of the engine on an intake stroke after said each exhaust valve is so opened.

12. A combination as claimed in claim 11, wherein the means for increasing includes means for restricting a flow of exhaust gases from the manifold.

13. A combination as claimed in claim 12, wherein the means for restricting includes a valve.

14. A combination as claimed in claim 11, wherein the means for increasing includes means for retarding opening of said each exhaust valve near top dead centre of said each compression stroke to increase the pressure of gases released from the first cylinder.

15. A combination as claimed in claim 14, wherein the valves are operated by push tubes, the means for opening said each exhaust valve including a slave cylinder having a slave piston operatively contacting said each exhaust valve, a master cylinder having a master piston for operatively contacting one said push tube, means and an hydraulic conduit between the master cylinder and the slave cylinder, the means for retarding including a gap between the one push tube and the master piston prior to said opening of the first exhaust valve.

* * * * *

US004848289C1

(12) EX PARTE REEXAMINATION CERTIFICATE (5218th)

United States Patent
Meneely

(10) Number: US 4,848,289 C1
(45) Certificate Issued: Oct. 18, 2005

(54) APPARATUS AND METHOD FOR RETARDING AN ENGINE

(75) Inventor: Vincent A. Meneely, Langley (CA)

(73) Assignee: Jenara Enterprises Ltd., Vancouver (CA)

Reexamination Request:
No. 90/006,764, Aug. 29, 2003

Reexamination Certificate for:

| | |
|---|---|
| Patent No.: | **4,848,289** |
| Issued: | **Jul. 18, 1989** |
| Appl. No.: | **07/189,282** |
| Filed: | **May 2, 1988** |

(51) Int. Cl.[7] ..... F01L 13/08; F02D 75/02
(52) U.S. Cl. ..... 123/182.1; 123/320
(58) Field of Search ..... 123/182.1, 320, 123/321, 322, 323, 90.13, 90.15

(56) References Cited

U.S. PATENT DOCUMENTS

| | | | |
|---|---|---|---|
| 3,220,392 | A | 11/1965 | Cummins |
| 3,525,317 | A | 8/1970 | Muir |
| 3,591,959 | A | 7/1971 | Kubis |
| 3,710,908 | A | 1/1973 | Muir |
| 4,062,332 | A | 12/1977 | Perr |
| 4,111,166 | A | 9/1978 | Alstrin et al. |
| 4,150,640 | A | 4/1979 | Egan |
| 4,296,605 | A | 10/1981 | Price |
| 4,333,430 | A | 6/1982 | Rosquist |
| 4,380,971 | A | 4/1983 | Tholen et al. |
| 4,393,831 | A | 7/1983 | Bergmann et al. |
| 4,398,510 | A | 8/1983 | Custer |
| 4,399,787 | A | 8/1983 | Cavanagh |
| 4,408,627 | A | 10/1983 | Harris |
| 4,423,712 | A | 1/1984 | Mayne et al. |
| 4,473,047 | A | 9/1984 | Jakuba et al. |
| 4,485,780 | A | 12/1984 | Price et al. |
| 4,556,027 | A | 12/1985 | Harris |
| 4,572,114 | A | 2/1986 | Sickler |
| 4,655,178 | A | 4/1987 | Meneely |
| 4,664,070 | A | 5/1987 | Meistrick et al. |
| 4,669,585 | A | 6/1987 | Harris |
| 4,688,384 | A | 8/1987 | Pearman |
| 4,697,558 | A | 10/1987 | Meneely |
| 4,700,684 | A | 10/1987 | Pischinger et al. |
| 4,706,625 | A | 11/1987 | Meistrick et al. |
| 4,741,307 | A | 5/1988 | Meneely |
| 4,742,806 | A | 5/1988 | Tart, Jr. et al. |
| 4,763,471 | A | 8/1988 | Keller |
| 4,779,600 | A | 10/1988 | Asaga et al. |
| 4,898,128 | A | 2/1990 | Meneely |

FOREIGN PATENT DOCUMENTS

| | | |
|---|---|---|
| DE | 39 22 884 A1 | 1/2001 |
| EP | 0 140 702 | 5/1985 |
| JP | 57-171011 | 10/1982 |
| JP | 2-267334 | 11/1990 |

OTHER PUBLICATIONS

C. Brake Familiarization (Cummins).
"Retarders: How, what and why."
SAE Technical Paper Series, No. 790769 "Compression Engine Brake Performance with Turbocharged Diesel Engines", Morse, et al.
"Vehicle Retarders: Present & Future", F.W. Mohney, et al., Jul. 12, 1977.
"A New Concept in Engine Testing Laboratories: The Jacobs Manufacturing Company", Stanislave Jakuba.
"The Mack Maxidyne, ENDT865 Diesel with Dynatard Engine Brake", J. F. Greathouse, et al.

(Continued)

*Primary Examiner*—Mahmoud Gimie

(57) ABSTRACT

The invention includes an apparatus for retarding an engine. There is a mechanism, such as a master and slave cylinder arrangement, for cracking open each exhaust valve of each cylinder of the engine near top dead center of each compression stroke. There is also provision for increasing the pressure of gases in the exhaust manifold sufficiently to open exhaust valves of other cylinders on the intake stroke after each exhaust valve on the compression stroke is so opened. The provision for increasing the pressure of gases in the exhaust manifold may include retarding timing of the cracking open of the exhaust valves on the compression stroke and a valve or other device for restricting a flow of exhaust gases from the exhaust manifold.

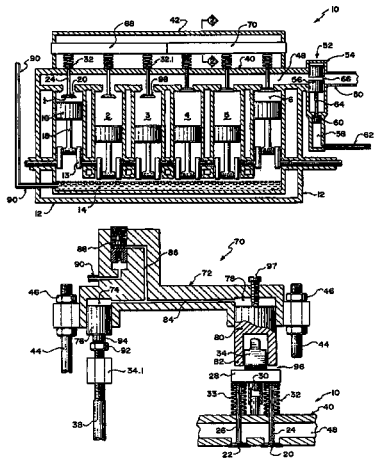

OTHER PUBLICATIONS

Catalog Issued Dec., 1975, "strong and silent. Compression Brake for Four Stroke Engines Only", Williams Air Controls.
"Strong and Silent" Compression Brake For Four Stroke Engines Only.
"Mitsubishi does some engine braking".
Commercial Carrier Journal, Dec. 1987, "Retarders: Giving Brakes a Chance", Paul Richards.
Design News: "Pterodactyl Connector Ensures Power Supply", Jun. 22, 1987.
High Speed Diesel Report.
"A New Breed of Engine Brake for the Cummins L10 Enging", R. B. Price, et al. 1983 Society of Automotive Engineers, Inc.
"New engine brake developed for Cummins L10 diesel", 1983 Society of Automotive Engineers, Inc.
SAE Technical Paper Series, "The Optimized Design of the Exhaust Brake of the Automotive Diesel Engine", Akiba, et al.
"Compression Engine Brake Performance with Turbocharged Diesel Engines", W. H. Morse, et al., 1979 Society of Automotive Engineers, Inc.
"The Jacobs Engine Brake Application and Performance", Don D. Cummins, Society of Automotive Engineers, Inc.
"Exhaust Brake Effectiveness", Bernt Johnson, Society of Automotive Engineers, Inc.
"The Jacobs Engine Brake—A New Concept in Vehicle Retarders", C. Lyle Cummins, Jr., et al., Society of Automotive Engineers, Inc.
"Compression Retarder", W. E. Meyer, The Pennsylvania State University.
"Manifold Braking for Heavy "Over the Road" Trucks a Review of European Practices and Experiences", W. E. Meyer, The Pennsylvania State University.
"A Study of the Effect of Oil and Coolant Temperatures on Diesel Engine Brake Specific Fuel Consumption", David A. Bolis, et al.
Okamura, H., "Development of Powertard for 8 DC 9T Engine", 23 Mitsubishi Heavy Industries Technical Review 1, 1–7 (1986).
Rife, J.M., Ph.D., and G.M. Bloom, Performance Analysis and Design of the Jake Brage (1976).
Okamura, H., "Trends in Auxiliary Engine Braking System," Journal of the Society of Automotive Engineers of Japan, vol. 38 (1984).

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *